US009869142B2

(12) United States Patent
Millet et al.

(10) Patent No.: US 9,869,142 B2
(45) Date of Patent: Jan. 16, 2018

(54) TORQUE ANCHOR FOR BLOCKING THE ROTATION OF A PRODUCTION STRING OF A WELL AND PUMPING INSTALLATION EQUIPPED WITH SUCH A TORQUE ANCHOR

(71) Applicant: PCM, Levallois-Perret (FR)

(72) Inventors: Francois Millet, Antony (FR); Stephen Burrows, La Chapelle sur Erdre (FR)

(73) Assignee: PCM TECHNOLOGIES (FR)

( * ) Notice: Subject to any disclaimer, the term of this patent is extended or adjusted under 35 U.S.C. 154(b) by 698 days.

(21) Appl. No.: 14/457,627

(22) Filed: Aug. 12, 2014

(65) Prior Publication Data

US 2015/0047829 A1 Feb. 19, 2015

(30) Foreign Application Priority Data

Aug. 13, 2013 (FR) ..... 13 57988

(51) Int. Cl.
*E21B 17/10* (2006.01)
*E21B 23/01* (2006.01)
(Continued)

(52) U.S. Cl.
CPC ..... *E21B 17/1057* (2013.01); *E21B 4/18* (2013.01); *E21B 17/10* (2013.01);
(Continued)

(58) Field of Classification Search
CPC ..... E21B 17/10; E21B 23/01; E21B 17/1057; E21B 17/1014
See application file for complete search history.

(56) References Cited

U.S. PATENT DOCUMENTS 3,808,697 A * 5/1974 Hall ..... G01C 9/00 33/312
4,377,207 A 3/1983 Kofahl
(Continued)

FOREIGN PATENT DOCUMENTS

WO 0043629 A1 7/2000

OTHER PUBLICATIONS

French National Institute of Industrial Property (INPI), French Preliminary Search Report issued in corresponding French Application No. FR1357988, dated Apr. 17, 2014.

*Primary Examiner* — Giovanna C. Wright
*Assistant Examiner* — Tara E Schimpf
(74) *Attorney, Agent, or Firm* — Patzik, Frank & Samotny Ltd.

(57) ABSTRACT

A torque anchor intended to block the rotation of a production string with respect to a casing of a well; the torque anchor comprising a body and anchor cassettes comprising a wheel having a circumference and a wheel spindle supporting said wheel, a contact point of the circumference of the wheel being intended to come into contact with the casing, an opposite point being arranged diametrically opposite the contact point.

For each anchor cassette, the wheel is mounted on the end of the wheel spindle; a positioning angle comprised between 30° and 180° being defined between a first straight line passing through the center of the casing and the contact point and a second straight line passing through the center of the casing and the opposite point.

27 Claims, 13 Drawing Sheets

(51) Int. Cl.
*E21B 43/12* (2006.01)
*E21B 4/18* (2006.01)

(52) U.S. Cl.
CPC ..... *E21B 17/1014* (2013.01); *E21B 23/01* (2013.01); *E21B 43/126* (2013.01)

(56) References Cited

U.S. PATENT DOCUMENTS

| | | | | |
|---|---|---|---|---|
| 6,227,313 | B1 | 5/2001 | Davis et al. | |
| 6,892,811 | B2 | 5/2005 | LaClare et al. | |
| 2009/0003974 | A1* | 1/2009 | Mcnay | E21B 17/1057 414/22.51 |
| 2012/0061099 | A1* | 3/2012 | Wold | E21B 23/01 166/382 |
| 2012/0145380 | A1 | 6/2012 | Draper et al. | |
| 2012/0222857 | A1 | 9/2012 | McNay | |

* cited by examiner

TORQUE ANCHOR FOR BLOCKING THE ROTATION OF A PRODUCTION STRING OF A WELL AND PUMPING INSTALLATION EQUIPPED WITH SUCH A TORQUE ANCHOR

RELATED APPLICATIONS

This invention claims priority to French patent application No. FR 13/57988, filed Aug. 13, 2013, the entirety of which is hereby incorporated by reference.

FIELD OF THE INVENTION

The invention relates to a torque anchor for blocking the rotation of a production string with respect to a casing of a well and/or of a pumping installation equipped with a progressing cavity pump comprising such a torque anchor.

BACKGROUND OF THE INVENTION

In its most widespread configuration, a pumping installation comprises a wellhead equipped with a surface bearing drive mounted on a "blowout preventer" remotely driving a progressing cavity pump mounted at the base of a production string or inserted into the production string. The pump is installed downhole. The bearing drive, at the wellhead, supports and drives in rotation a drive shaft called a "polished rod". The polished rod drives a drill string (or a continuous pipe) located inside and throughout the length of the production string. This drill string in turn drives in rotation the rotor of the progressing cavity pump situated downhole. The fluid, situated downhole, is transferred through the pump and delivered into the production string up to the wellhead, from where it is evacuated by distribution pipes. The torque anchor holds the stator of the pump in such a way that it is not itself driven in rotation downhole and thus prevents the disconnection of the tubing forming the production string.

Torque anchors are known, in particular from the document U.S. Pat. No. 6,155,346, for a pumping installation, comprising teeth mounted on a cam, fixed to the tubing string. The teeth are suitable for being moved, via the cam, between a retracted position within the torque anchor and a blocking position in which the teeth extend radially outside the body of the torque anchor and grip the casing.

Such torque anchors have numerous disadvantages.

Firstly, they are based on interference techniques, and are therefore likely to become dislodged during production due to the strong vibrations generated by the progressing cavity pump. This dislodging can lead to the tubing string becoming unscrewed and falling downhole, involving a complete shutdown of the production operations and a significant cost for carrying out fishing operations.

Then, in certain cases, the retraction mechanism can become clogged due to the presence of sand, or be degraded by corrosion. In this case, the torque anchor is raised by force so that the casing and the downhole equipment are damaged.

Furthermore, the teeth are brought into blocking position by the rotation of the tubing string from the surface, carried out by operators using grip wrenches. This driving operation presents a certain risk to the safety of the operators handling the grip wrenches in order to impart a torsional stress. In fact, when the grip wrench slips, it can injure the operators.

Moreover, in normal operation, the interference of the teeth in principle leads to extremely high contact pressures between said teeth and the casing. Thus, given the high level of vibration during pumping, it is strongly suspected that the teeth, the form of which is necessarily aggressive in order to initiate interference, "machine" the casing.

Moreover, certain wells are subjected to significant variations in temperature during production. These temperature variations expand the tubing string which can be extended by a length of up to 6 meters, but do not expand, or only slightly expand, the casing since this is cemented to the formation. During these temperature variations, the torque anchor, pushed by the expansion of the production string, is displaced relative to the casing along the longitudinal axis of the well. As the teeth of the torque anchor are still anchored in the casing, definite damage caused by notching of the inner wall of the casing is suspected but has thus far not been quantified.

Finally, in order to be sure that the teeth of the torque anchor are firmly gripping the casing, they can be driven into blocking position at the surface of the well before the torque anchor is lowered downhole. In this case, the casing pipe assembly is cut and damaged during the descent of the torque anchor downhole.

The document EP 1 371 810 describes an anti-rotation device for a drilling rig of the type comprising a rotatable shaft and a housing containing the rotatable shaft. The anti-rotation device is suited to blocking the rotation of the housing in the wellbore. It comprises carriages provided with rollers mounted on a shaft perpendicular to the longitudinal axis of the housing. The edge of the roller is tapered so as to engage the rock of the wellbore and, by means of this engagement, to prevent any rotation of the drilling rig.

However, this anti-rotation device is not suitable for use in a casing as the tapered surface of the rollers risks cutting and damaging the casing. Furthermore, this device is undersized with respect to the torsional stresses applied by a stator to the production string, when the rotor is driven in rotation. Such a device could only counter such stresses by increasing its size in such a way that it could no longer be inserted into the production string.

SUMMARY OF THE INVENTION

The purpose of the present invention is to propose a torque anchor capable of moving along the longitudinal axis of the well, minimizing damage to the casing while still resisting high torques.

Such high torques occur in wells pumping heavy hydrocarbons (presence of sand, aromatic oils, high viscosities) or water, in particular when using metal stators (those of metal/metal pumps of the PCM Vulcain™ type), high-throughput progressing cavity pumps, or when the pumping is carried out under particular operating conditions in which vibration stresses are significant or at temperatures that may reach 350° C.

To this end, a subject of the invention is a torque anchor intended to block the rotation of a production string with respect to a casing of a well having a longitudinal axis; the torque anchor comprising:

a body;

anchor cassettes borne by the body; each anchor cassette comprising a wheel having a circumference and a wheel spindle supporting said wheel, said wheel spindle having an end;

a contact point of the circumference of the wheel being intended to come into contact with the casing, an opposite point being arranged diametrically opposite the contact point, wherein for each anchor cassette, said wheel is mounted on said end of said wheel spindle; a positioning angle comprised between 30° and 180°, and advantageously between 60° and 90°, being defined between a first straight line and a second straight line, said first straight line passing through the centre of the casing and the contact point, said second straight line passing through the centre of the casing and said opposite point.

Advantageously, with the spindle bearing the wheel in this position, a tangential force is applied to the wheels at a single point of contact of the wheel, when lowering the torque anchor for completion or when the length of the casing is modified by expansion. This force drives the wheels in rotation and thus makes it possible to move the torque anchor along the casing while minimizing damage thereto (cyclical strain hardening and not stripping of material as in the case of existing products). When this tangential force is not applied to the wheels, i.e. when the torque anchor is not moving along the casing, the torque exerted by the stator is contained within a plane containing the wheel spindles so that the wheels are not driven in rotation.

According to particular embodiments, the torque anchor comprises one or more of the following features:

In each anchor cassette, said wheel is mobile in a direction of movement parallel to the wheel spindle and in which each anchor cassette comprises a loading device suitable for exerting a force on said wheel in said direction of movement in order to anchor said wheel in said casing;

Advantageously, the positioning of the wheel combined with the direction of application of force of the loading device makes it possible to obtain a higher resisting torque than in the devices of the state of the art in which the direction of application of the force of the restraining device is perpendicular to the axis of the wheels. Consequently, a loading device with smaller dimensions can be used in the torque anchor according to the present invention. This makes it possible to produce very compact torque anchors.

Furthermore, advantageously, this loading device plays a role of suspension in the sense that it allows each wheel to move radially as a function of the irregularities linked either to variations in the diameter of the casing pipes forming the casing or to a local deformation or local corrosion of a pipe. It also makes it possible to use the torque anchor in different pumping wells the casings of which do not all have the same inner diameter or wall thickness.

Said loading device comprises N springs distributed regularly about the wheel spindle, N being a natural integer greater than or equal to one;

N is equal to two, said two springs being arranged co-axially with said wheel spindle, and in which said anchor cassette comprises a thrust washer arranged between said wheel and said springs;

Advantageously, the use of two concentric springs makes it possible to apply a significant force to the wheels. The thrust washer makes it possible to guarantee that the forces applied to the wheel by the springs are uniformly distributed.

Said anchor cassette comprises a bearing suitable for supporting said wheel and in which each bearing comprises a protrusion delimiting an inner chamber containing said N springs, said protrusion being suitable for guiding said N springs in translational motion in said protrusion as well as in rotation about the wheel spindle;

Advantageously, the protrusion makes it possible to hold the springs in place, only one side of the wheels being subjected to a significant load originating from the torque exerted by the stator and from the contact with the casing.

The torque anchor comprises at least one fluid opening between the outside of the body and said inner chamber;

Advantageously, this fluid opening allows the fluid to be drawn in or discharged according to the variations in volume of the inner chamber linked to the compression or extension of the springs. By reducing the size of this opening, it is possible to increase the damping of the movements of the wheels in the direction of the wheel spindle by making the fluid pass through a narrow/restricted opening (choke).

Advantageously also, the pumped fluid can penetrate through these openings and lubricate the springs, thus increasing their lifetime in particular when the fluid is previously filtered.

The body comprises housings forming a slide opening towards the outside; each housing being suitable for containing an anchor cassette;

Thus advantageously, all of the parts contained in the anchor cassette can be freely and easily removed from the housing and changed during the torque anchor maintenance operations.

Said bearing is suitable for sliding in said housing, said bearing adhering to said housing by addition of grease to their interface;

As the bearing contains the wheel spindle, said N number of springs and if appropriate the thrust washer, all of these components can be easily removed from the housing.

Sticking with grease makes it possible to lubricate the contact between the housing and the bearing while producing a slight resistance to the removal of the anchor cassette on maintenance of the torque anchor outside the casing.

The anchor cassettes each comprise a thrust bearing suitable for bearing said wheel spindle, said thrust bearing comprising at least one shoulder forming a bearing surface for said loading device;

The wheel spindles are flush-fitted to said wheels, and preferably shrink-fitted to said wheels;

Thus, advantageously, the wheel is attached to the wheel spindle without an attaching part, thus improving the reliability of the system and thus avoiding any risk of loss of components in the well provided that the coefficients of expansion of the materials in contact are identical, or sufficiently close for the differential expansion to be negligible.

One end of said wheel spindle is provided with a collar and in which said thrust bearing comprises an inner circular recess suitable for receiving said collar in order to pre-stress the loading device;

Advantageously, the collar makes it possible to preload the cassettes forming a single sub-assembly; and hence to remove the thrust bearing from the housing during maintenance operations.

The torque anchor comprises a reservoir having an opening which extends in a plane substantially parallel to the plane containing the wheel spindles;

Advantageously, this reservoir makes it possible to collect the debris originating from the production string, thus avoiding the use of a debris collector generally called a "bull plug".

Advantageously, this reservoir also forms a rotor positioning stop generally called a "tag bar" or "stop bushing" which makes it possible to know that the rotor has been lowered a sufficient distance, deep enough to be correctly positioned in the stator assembly.

The diameter of the wheels is comprised between 20% and 80% of the value of the internal diameter of the casing;

Advantageously, this large diameter reduces the contact pressure of the wheel against the casing. Thus, the casing is less damaged and less worn despite repeated passes of the torque anchor during the cyclic expansions of the casing and maintenance operations.

Advantageously, this large diameter allows the wheels to pass over the casing joint, i.e. the joint between two adjacent pipes forming the casing, without marked damage to the wheel and the casing.

The wheels have an outer circular face the peripheral edge of which is provided with a flange intended to come into contact with the casing, when the torque anchor is installed in the casing;

Said wheels are suitable for applying to said casing a theoretical contact pressure calculated according to Hertz's formulae comprised between 2 and 20 times the elastic limit of the casing and preferably between 4 and 10 times the elastic limit of the casing;

The bearing and/or the thrust bearing is made of ceramic material;

The body comprises a first direction, a second direction and a third direction defining an orthonormal matrix; the first direction extending parallel to said longitudinal axis of the well, when the torque anchor is arranged in said casing; the body also comprises a radial plane containing the second direction and the third direction, a first axial plane containing the first direction and the second direction and a second axial plane containing the first direction and the third direction, the first axial plane and the second axial plane passing through the centre of the casing;

and in which said anchor cassettes comprise a first anchor cassette and a second anchor cassette arranged in a first radial plane, known as the first stage; the first anchor cassette comprises a first wheel spindle and the second anchor cassette comprises a second wheel spindle; the first wheel spindle and the second wheel spindle are parallel to each other and are arranged on either side of the second axial plane; the first wheel spindle and the second wheel spindle being offset with respect to the centre of the casing by the same offset value in the third direction;

The torque anchor comprises a third anchor cassette and a fourth anchor cassette arranged in a second radial plane, known as the second stage; the second stage being offset in the first direction with respect to the first stage; and in which the third anchor cassette and the fourth anchor cassette are positioned with respect to the first anchor cassette and the second anchor cassette according to a geometric transformation comprising at least one axial symmetry with respect to a first axis parallel to the second direction and passing through the centre of the casing; said axis being contained in a radial plane situated at a predefined distance from the plane containing the first wheel spindle and the second wheel spindle;

Advantageously, the torque anchor does not rotate about the centre of the body during its translational motion along the axis of the casing. This configuration also improves the centring of the torque anchor inside the casing and the resisting torque of the torque anchor in both directions of rotation.

The torque anchor comprises a third anchor cassette and a fourth anchor cassette arranged in a second radial plane, known as the second stage; the second stage being offset in the first direction with respect to the first stage; and in which the third anchor cassette and the fourth anchor cassette are positioned with respect to the first anchor cassette and the second anchor cassette according to a geometric transformation comprising a rotation, for example, through an angle of 90°, with respect to an axis parallel to the first direction and passing through the centre of the body;

The body comprises a first direction, a second direction and a third direction defining an orthonormal matrix; the first direction extending parallel to said longitudinal axis of the well, when the torque anchor is arranged in said casing; the body also comprises a radial plane containing the second direction and the third direction, a first axial plane containing the first direction and the second direction and a second axial plane containing the first direction and the third direction, the first axial plane and the second axial plane passing through the centre of the casing;

and in which said anchor cassettes comprise a first anchor cassette, a second anchor cassette, a third anchor cassette and a fourth anchor cassette arranged in one and the same radial plane, the wheel spindles of each anchor cassette are parallel to each other; the first anchor cassette and the third anchor cassette are arranged on one side of the second axial plane; the second anchor cassette and the fourth anchor cassette are arranged on the other side of the second axial plane; the first anchor cassette and the second anchor cassette are arranged on one side of the first axial plane, the third anchor cassette and the fourth anchor cassette are arranged on the other side of the first axial plane.

Advantageously, the torque anchor according to this embodiment is well positioned in the centre of the casing and offers significant resisting torque per unit of length. The diameter of the wheels is smaller in this embodiment which could possibly lead to greater damage to the wheels when passing over a casing joint and possibly to difficulties in passing over the casing joints.

A subject of the invention is also a pumping installation comprising a torque anchor according to any one of the abovementioned features;

Preferably, said torque anchor is fixed downhole at the end of said pumping installation.

Advantageously, in this configuration, the stator is at a distance from the torque anchor such that the torque anchor is subject to weaker vibrations. Advantageously, a perforated tube several meters in length is fixed between the bottom end of the stator and the torque anchor so that the vibrations are further attenuated.

As a variant, the installation comprises a progressing cavity pump provided with a stator and a helical rotor arranged in the stator, the torque anchor being fixed directly to the stator.

Advantageously, in this configuration, the torque anchor performs the function of rotor positioning stop, of debris collector and therefore necessarily of perforated tube/filtering equipment.

BRIEF DESCRIPTION OF THE DRAWINGS

The invention will be better understood on reading the following description, given by way of example only and with reference to the figures in which.

DETAILED DESCRIPTION OF THE INVENTION

In the following description, elements which are identical or similar are referred to by the same reference number and are described only once. The present invention is defined with respect to an orthogonal matrix R (X, Y, Z) shown in FIG. 1. The direction of the vectors X, Y and Z is defined as being the positive direction. The opposite direction is defined as being a negative direction. By convention, the direction Z of the matrix R (X, Y, Z) is called "first direction", the direction X of this matrix is called "second direction" and the direction Y of this matrix is called "third direction". The terms "top", "bottom", "lower", "upper", "right" and "left" are defined when the torque anchor according to the invention is arranged as illustrated in FIG. 1, and are in no way limitative.

The torque anchor according to the present invention is mainly intended to be mounted in a casing of a hydrocarbons, water or gas pumping installation. By convention, the first direction Z extends parallel to the longitudinal axis of the casing in which the torque anchor is intended to be installed. The second direction X and the third direction Y extend in a plane radial to this casing. By convention also, the plane containing the second direction X and the third direction Y is called the radial plane (X, Y), the plane containing the first direction Z and the second direction X and passing through the centre O of the casing 15, is called the first axial plane (Z, X) and, finally, the plane containing the first direction Z and the third direction Y and passing through the centre O of the casing 15, is called the second axial plane (Y, Z). The casing 15 is cylindrical in shape. The centre O of the casing 15 is defined according to the present invention as being any point situated on the axis of this cylinder.

Figure 1:
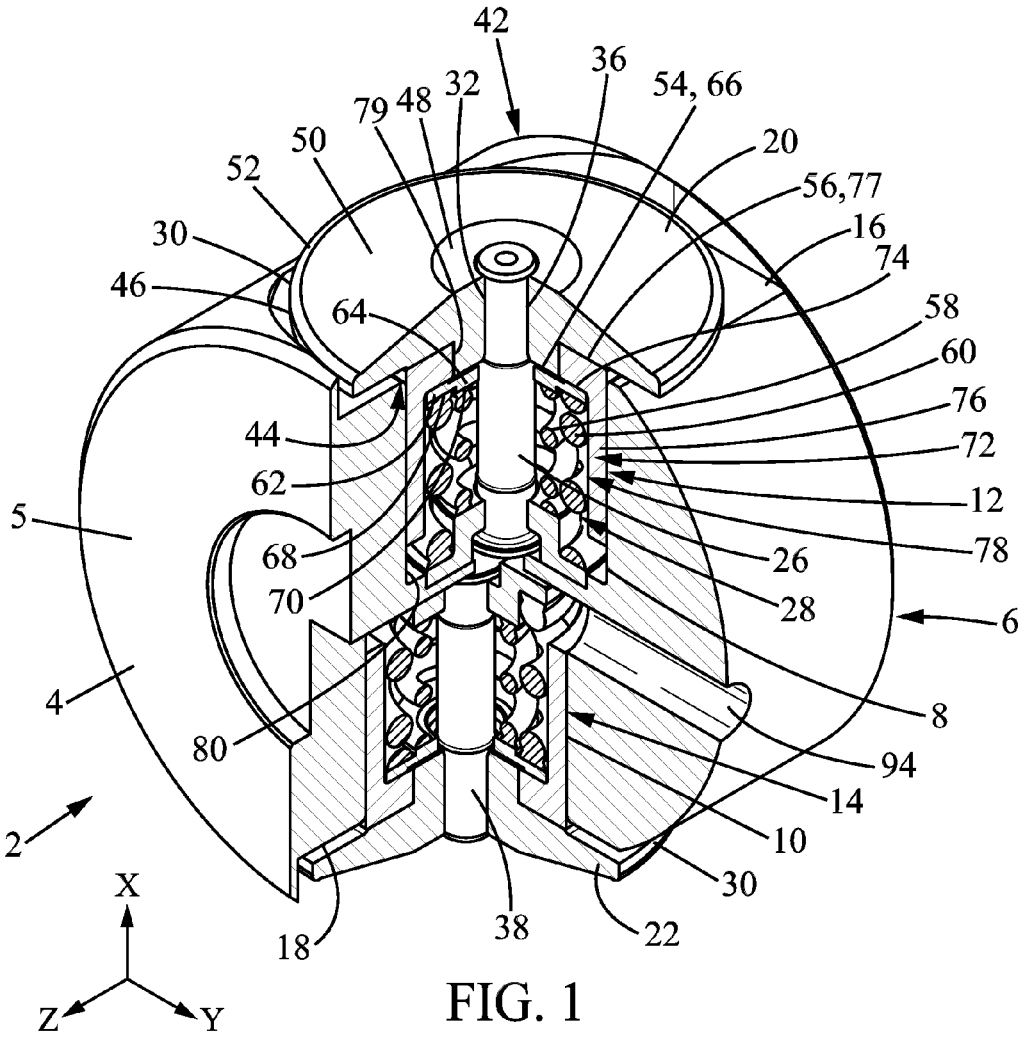
FIG. 1 is a cut-away perspective view of a torque anchor according to a first embodiment of the invention.
Figure 2:
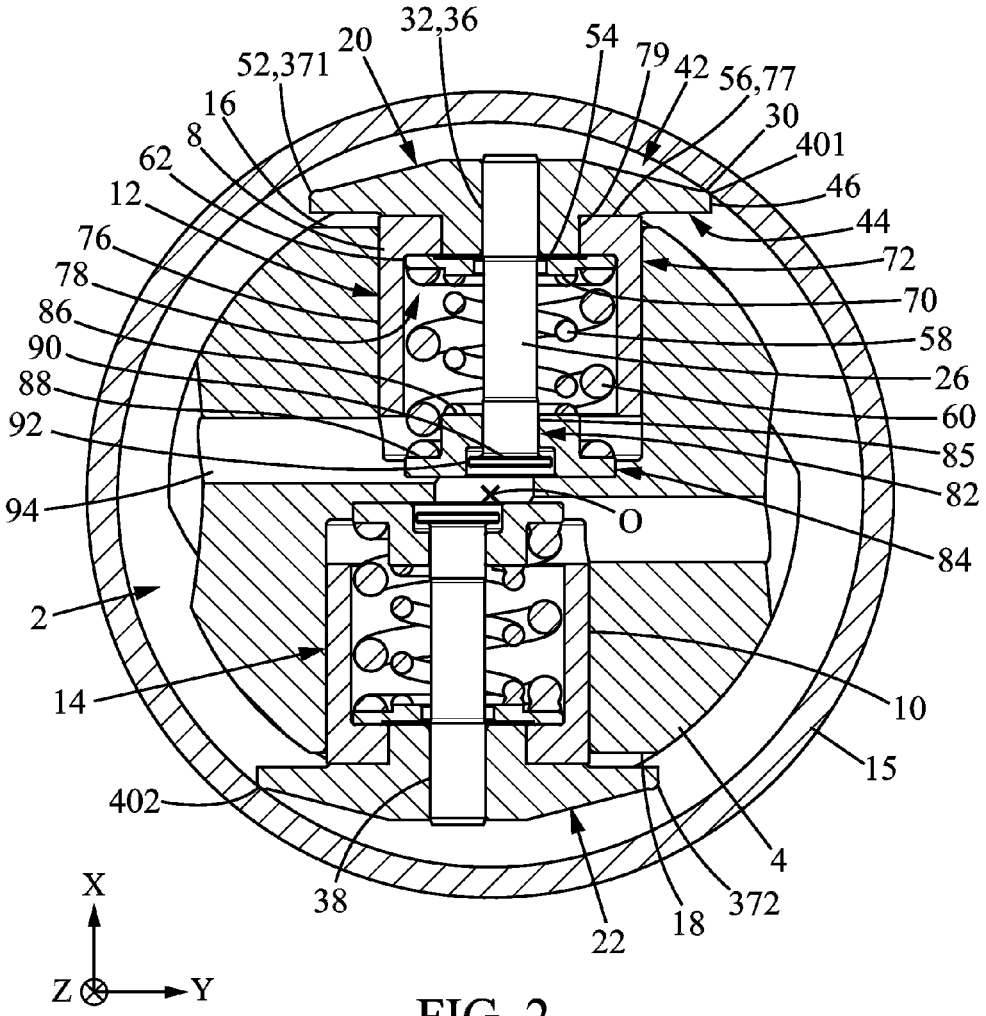
FIG. 2 is a cross-sectional view in a plane perpendicular to the axis of the casing of the torque anchor illustrated in FIG. 1.

With reference to FIGS. 1 and 2, the torque anchor 2 according to the first embodiment of the invention comprises a body 4 having two end faces 5, 6 extending parallel to the radial plane (X, Y). The end faces are intended to be fixed, for example by screwing, by pinning or by welding, to the stator of a progressing cavity pump or to perforated filtering equipment generally called a perforated tube or perforated pipe, slotted screen or sand screen, or also to another body in order to form a torque anchor having a greater number of anchor cassettes as explained below.

The body 4 comprises a first cylindrical housing 8 and a second cylindrical housing 10, one containing a first anchor cassette 12 and the other a second anchor cassette 14.

As can be seen in FIG. 2, the first housing 8 and the second housing 10 extend in the second direction X, in one and the same radial plane (X, Y). By convention, this torque anchor is described as single-stage. The first housing 8 and the second housing 10 are arranged on either side of the second axial plane (Y, Z) and are offset with respect to the centre O of the casing 15 in the third direction Y, advantageously by the same value, the one in a positive direction, the other in a negative direction.

The first housing 8 and the second housing 10 each open onto a flat 16, 18, one receiving a part of a first wheel 20 of the first anchor cassette 12 and the other, a part of the second wheel 22 of the second anchor cassette 14.

The first anchor cassette 12 and the second 14 are similar. In order to simplify the description, only the first anchor cassette 12 will be described in detail. Only the differences in positioning of the elements of each of the anchor cassettes will be described.

The first anchor cassette 12 comprises a first wheel 20, a first wheel spindle 26 supporting the first wheel 20, and a loading device 28 capable of applying a force to the first wheel 20, via suitable intermediate parts, in a direction axial to said wheel 20.

The first wheel 20 has a circular circumference 30 and a central bore 32. One end 36 of the first wheel spindle is flush-mounted in the central bore 32 of the first wheel.

The first wheel spindle 26 is offset in a direction perpendicular to a straight line D1 passing substantially through the centre O of the casing 15 and parallel to the first wheel spindle 26. In particular, the first wheel spindle 26 is positioned offset in the positive direction of the third direction Y. Consequently, the first wheel 20 extends projecting outside the body 4 in a positive direction Y.

The second wheel 22 is supported by a second wheel spindle 38 which is offset with respect to the centre O of the casing 15 in the negative direction of the third direction Y. The second wheel 22 extends projecting outside the body 4 in a negative direction Y.

In the embodiments illustrated, the first wheel spindle 26 of the first wheel and the second wheel spindle 38 of the second wheel are offset with respect to the centre of the body 4. But this positioning is in no way limitative.

The offset δ of the first wheel spindle 26 in the third direction Y has a length comprised between 0.1% and 10%, and advantageously comprised between 3% and 5% of the inner diameter of the casing.

Thus, when the torque anchor 2 is arranged in said casing 15, part of the circumference 30 of the first wheel engages with the casing 15 at one contact point 401 only, the remaining circumference of the first wheel being at a distance from said casing 15.

This configuration allows the first wheel 20 to rotate freely when a force parallel to the first direction Z is applied to the body 4 and simultaneously to become anchored in the casing 15 when a torque load is applied to it such as the torque induced in the stator by the rotation of the rotor.

Figure 3:
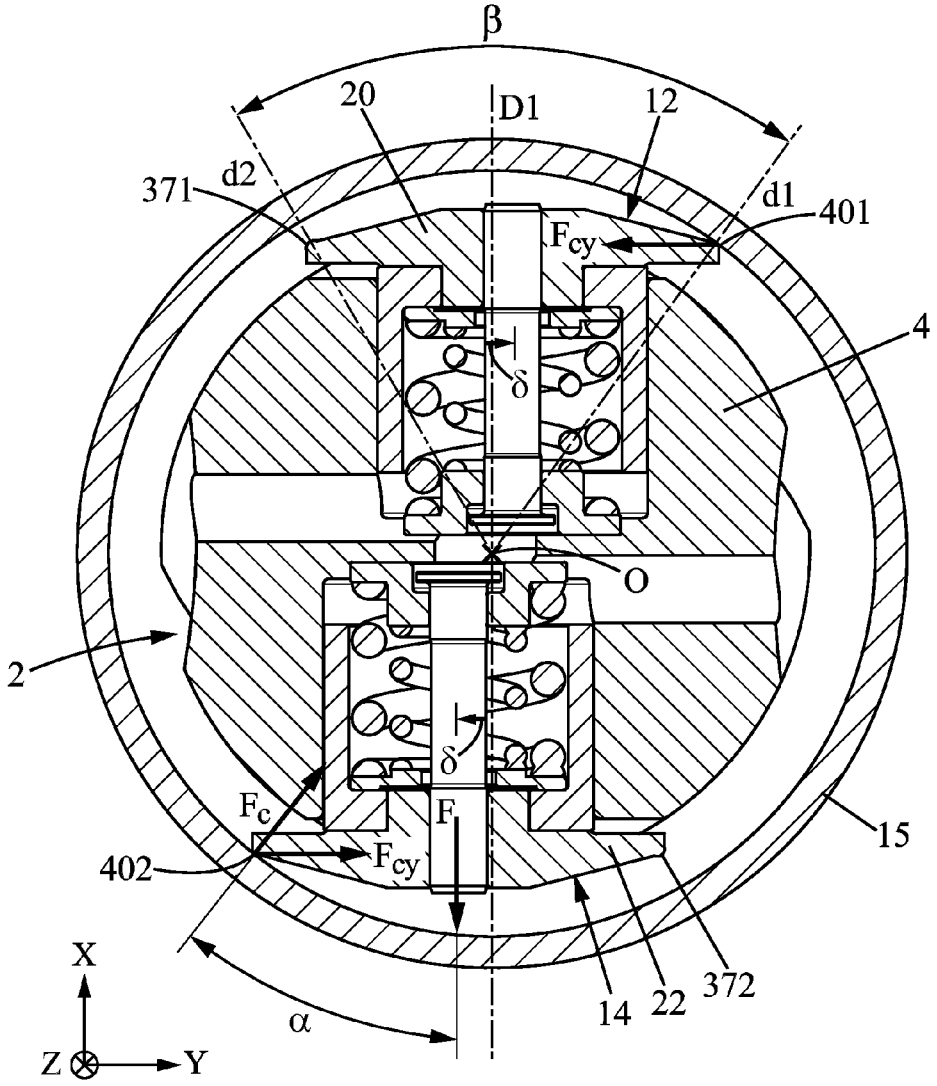
FIG. 3 is a view identical to FIG. 2 showing a first straight line and a second straight line.

In particular, with reference to FIG. 3, when the torque anchor 2 is arranged in said casing 15, the circumference 30 of the first wheel comes into contact with the casing 15, at each moment, at a contact point 401. At this moment, the point 371 of the circumference of the wheel diametrically opposite the contact point 401, is hereafter called by convention, opposite point 371.

The first wheel 20 is arranged inside the casing 15 and extends in a direction tangential to the casing 15 so that a non-zero positioning angle β is defined between a first straight line d1 passing through the centre O of the casing 15 and the contact point 401, and a second straight line d2 passing through the centre O of the casing and said opposite point 371. Preferably, the positioning angle β is comprised between 30 and 180°, and advantageously between 60 and 90°.

In the same way, the first straight line d1 also passes through the contact point 402 of the second wheel 22, and the second straight line d2 passes through the opposite point 372 at the contact point 402. The same positioning angle β exists between the first straight line d1 and the second straight line d2.

Preferably, the end 36 of the first wheel spindle 26 is shrink-fitted into the central bore 32 of the first wheel. Thus, the first wheel 20 and the first wheel spindle 26 are firmly fixed to each other and turn together when the torque anchor 2 moves along the longitudinal axis of the casing.

The first wheel 20 has a constant diameter comprised between 20% and 80%, and preferably comprised between 50% and 70% of the value of the inner diameter of the casing 15. This dimension advantageously makes it possible to minimize damage to the casing as well as to the wheels, to pass the casing joints without causing localized overload, and to minimize the axial overload when the first wheel 20 runs along the casing.

With reference to FIG. 2, the first wheel 20 has an outer circular face 42 intended to face the casing 15, an inner circular face 44 opposite to the outer circular face 42 and a cylindrical portion 46 linking the outer circular face 42 to the inner circular face 44.

The outer circular face 42 of the first wheel comprises a flat central portion 48 surrounded by an annular face 50 having the general shape of a truncated cone. The peripheral edge of the annular face 50 is provided with a flange 52, forming an open toric portion, intended to run along the casing 15 and to become anchored therein by controlled indentation. It is provided with a coating increasing its wear resistance. The coefficient of friction of this coating allows optimization of the adherence to the casing 15. This coating is, for example, made of tungsten carbide or synthetic diamonds.

When the torque anchor 2 is installed in the casing 15, only one part of the flange 52 of the first wheel 20 and one part of the flange 52 of the second wheel 22 positioned in opposed manner with respect to the diameter of the casing 15, at the points of contact 401 and 402 respectively, are in contact with the casing 15. Thus, at least a part of the forces exerted by the casing 15 on the torque anchor are exerted in opposite directions and at least partially compensate each other.

The inner circular face 44 is provided with a first central shoulder 54 forming a bearing surface for the loading device 28, and a second shoulder 56 extending around the first shoulder 54.

Preferably, the loading device 28 comprises an inner helical spring 58 and an outer helical spring 60, mounted one inside the other and coaxially with the first wheel spindle 26, and a thrust washer 62 suitable for ensuring that the stresses applied by the inner spring 58 and the outer spring 60 are directed parallel to the first wheel spindle 26.

Advantageously, the inner spring 58 and the outer spring 60 are wound in opposite directions. Preferably, the inner spring 58 and the outer spring 60 are nested springs.

As a variant, the inner spring 58 and the outer spring 60 are coiled wave springs.

The total stiffness constant of the springs is determined such that the theoretical pressure of the flange 52 of the first wheel on the inner face of the casing 15 at a contact point 401, calculated according to the formulae established by Heinrich Rudolf Hertz, is comprised between 2 and 20 times the elastic limit of the casing 15 and preferably between 4 and 10 times the elastic limit of the casing 15 over the range of variation of the inner diameter of the casing 15 (said variation being linked to the expansion, the manufacturing tolerances and the corrosion condition of the casing) so as to minimize the damage to the casing 15 by work-hardening while still providing sufficient attachment. The elastic limit is defined as the stress at which a material ceases to be elastically and reversibly deformed and thus commences to be plastically and irreversibly deformed.

With reference to FIG. 3, the positioning of the first wheel 20 with respect to the casing 15, the diameter of the first wheel 20 and the direction of application of the force F exerted by the loading device 28 are particularly advantageous since the resisting torque of the torque anchor 2 is proportional to 1/cos α; the angle α being defined as the angle between the force F applied by the loading device 28 and the force Fc normal to the surface of contact of the casing 15. The greater the angle α, the greater the resisting torque. Advantageously, according to the present invention this angle is comprised between 20° and 45°.

According to the most advantageous embodiment shown in the figures, the force Fc applied by the loading device 28 has the same direction as the first wheel spindle 26, but it can be envisaged that the loading device 28 has a different direction.

With reference to FIG. 1, the thrust washer 62 prevents the inner 58 and outer springs 60 being in contact with the first wheel 20 which rotates, whereas the springs do not rotate. It has an upper face 64 having a central portion 66 and a lower face 68 on which the inner and outer springs are supported.

The central portion 66 is ground to limit friction with the first wheel 20 and to facilitate the rotation of this wheel during the longitudinal movement of the torque anchor in the casing 15.

Advantageously, the lower face 68 of the thrust washer is provided with a central shoulder 70 on which the inner spring 58 is supported. The first wheel 20 also rests on an annular bearing 72 positioned against the second shoulder 56 of the first wheel and centred thereon.

The bearing 72 comprises a protrusion 76 extending parallel to the first wheel spindle 26. This protrusion 76 forms a sleeve delimiting an inner chamber 78 containing the inner spring 58 and the outer spring 60. This inner chamber 78 guides the inner 58 and outer 60 springs, during their extension and compression.

The bearing 72 comprises a support face 77 arranged opposite a peripheral part 74 of the thrust washer 62, and an annular linear face 79 extending perpendicular to the support face 77. The support face 77 transmits the thrust of the springs to the first wheel. The annular linear face 79 guides the first wheel in rotation.

The inner wall 80 of the first housing 8 is smooth and continuous so that the first housing 8 forms a slide opening outwards. Thus, the bearing 72 slides freely in the first housing 8 in the second direction X. Thus, the first wheel 20, the first wheel spindle 26, the inner spring 58, the outer spring 60 and the bearing 72 can be easily removed from the first housing 8 during the torque anchor maintenance operations.

Advantageously, the bearing 72 has a shape complementary to the shape of the first housing 8. Advantageously also, the bearing 72 is covered with grease before being inserted into the first housing 8. Thus, the bearing 72 adheres to the first housing 8 in order to limit its movement temporarily during the handling of the torque anchor on site.

The first wheel 20 is mobile in a direction of movement parallel to the first wheel spindle 26. The inner spring 58 and the outer spring 60 exert a force F on the thrust washer 64 and the bearing 72 in this direction of movement which tends to bring the first wheel 20 into contact with the casing 15 with a controlled point load (Hertz pressure).

The second housing 10 is similar to the first housing 8.

With reference to FIG. 2, one end 82 of the first wheel spindle opposite the end 36 supporting the first wheel 20, is borne by an annular thrust bearing 84. This thrust bearing 84 comprises an inner annular linear face 85 guiding the first wheel spindle 26 in rotation. This thrust bearing 84 is also a stop for the loading device 28. To this end, it comprises a central shoulder 86 and a peripheral shoulder 88 on which the respectively inner 58 and outer springs 60 are in abutment.

The bearing 72 and the thrust bearing 84 are advantageously made of ceramic material to avoid any risk of seizing of the elements guiding the first wheel in rotation. This material also makes it possible to contain any risk of anaerobic corrosion. This embodiment is desirable in applications requiring a long lifetime or at high temperature.

The end 82 of the first wheel spindle is provided with a collar 90 housed in an inner recess 92 of the thrust bearing 84. The thrust bearing 84 makes it possible to pre-stress the respectively inner and outer springs 58 and 60 in the workshop in order to facilitate the maintenance of the torque anchor and its introduction into the casing.

During operation, when the torque anchor 2 is inserted into the casing 15, the collar 90 is not in contact with the lower face of the central shoulder 86, nor with the recess 92 nor with a face of the body situated below the first wheel spindle 26.

Advantageously, this collar 90 makes it possible to remove the thrust bearing 84 out of the first housing 8 during the withdrawal of the first wheel spindle 26. Thus, the thrust bearing 84 can be replaced, during maintenance operations.

The body 4 also comprises a fluid opening 94 extending between the inner chamber 78 and the outside of the body. This fluid opening 94 makes it possible to compensate the pressure variations in the inner chamber 78 during the compression and extension of the inner spring 58 and the outer spring 60.

As a variant, the loading device 28 comprises several springs distributed regularly about the wheel spindle. For example, these springs are arranged co-axially with the first wheel spindle 26. According to another example, these springs are distributed, on either side of the first wheel spindle 26, along a line passing through the first wheel spindle 26.

As a variant, the inner spring 58 and the outer spring 60 are replaced by N springs distributed at 360°/N about the first wheel spindle 26.

Figure 4:
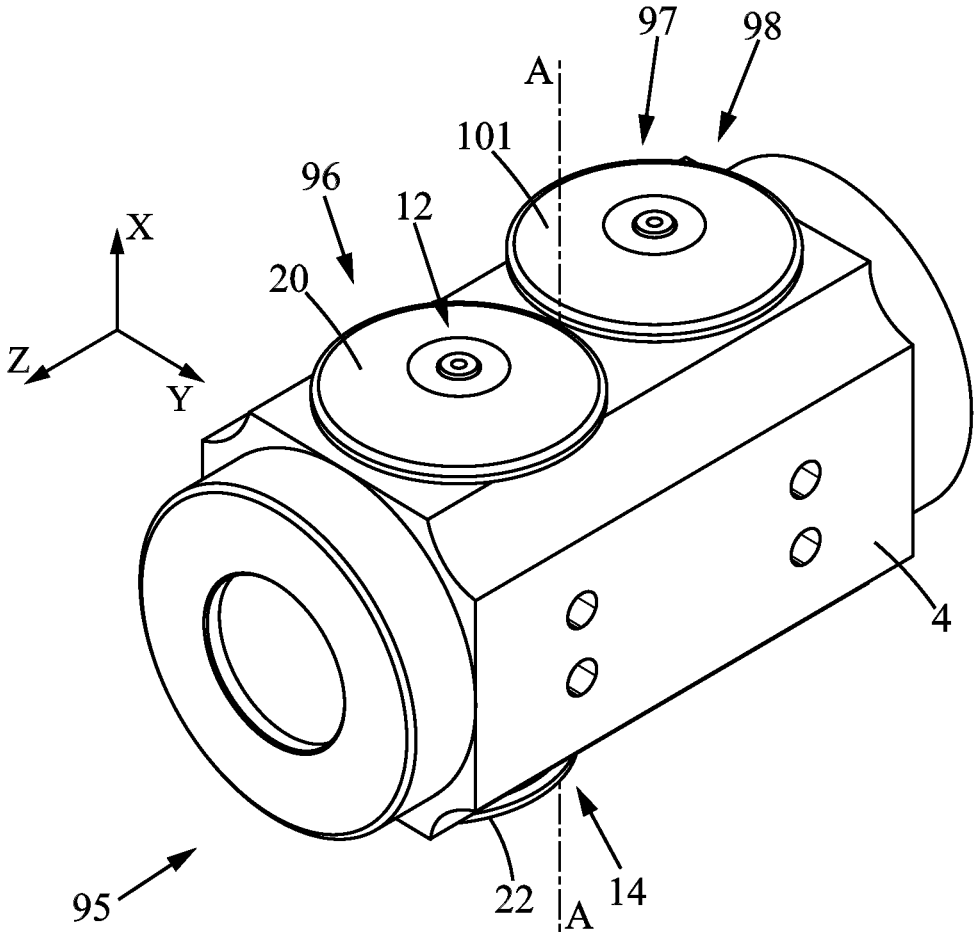
FIG. 4 is a perspective view of a first variant of the torque anchor illustrated in FIG. 1.
Figure 5:
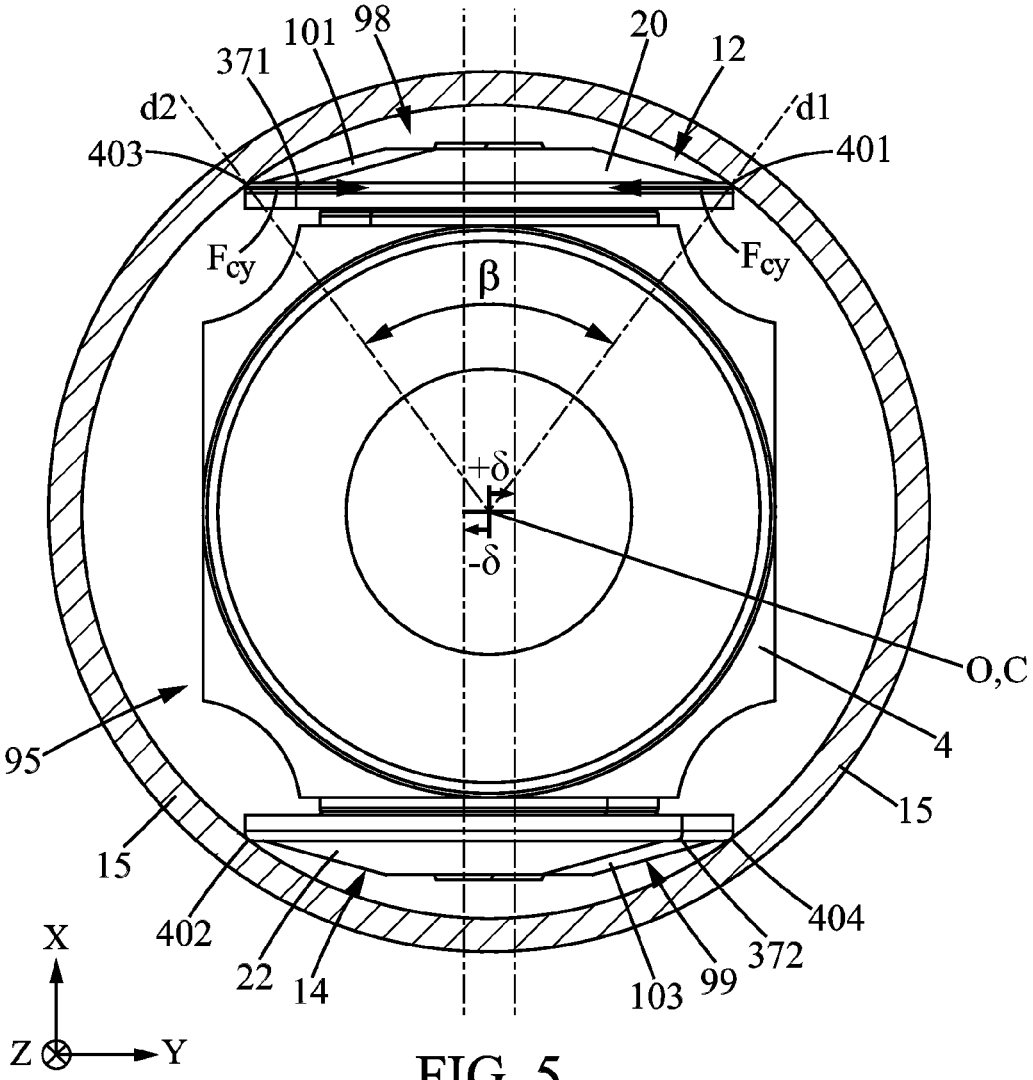
FIG. 5 is a top view of the torque anchor illustrated in FIG. 4.

According to a first embodiment variant illustrated in FIGS. 4 and 5, the torque anchor 95 comprises a first stage 96 and a second stage 97. The first stage 96 contains, in a first radial plane (X, Y), a first anchor cassette 12 and a second anchor cassette 14. The second stage 97 contains a third anchor cassette 98 and a fourth anchor cassette 99 in a second radial plane offset in the first direction Z with respect to the first radial plane.

The wheel spindles of the anchor cassettes 12, 14, 98, 99 of the first stage 96 and of the second stage 97 extend in the second direction X.

Just as for the first embodiment, in the first stage 96, the wheel spindle of the first wheel 20 of the first anchor cassette 12 is positioned offset by a value δ in a positive direction of the third direction Y and the wheel spindle of the second wheel 22 of the second anchor cassette 14 is positioned offset by a value δ in a negative direction of this same direction Y.

Advantageously, according to this first variant, the positioning of the anchor cassettes 98, 99 of the second stage 97 is a geometrical transformation of the positioning of the anchor cassettes 12. 14 of the first stage 96. This geometrical transformation is an axial symmetry with respect to a first axis A-A. The first axis A-A is parallel to the second direction X and passes through the centre O of the casing. In particular, the first axis A-A is contained in a radial plane (X, Y) situated at a predefined distance from the plane containing the first wheel spindle and the second wheel spindle. Said predefined distance is greater than or equal to whichever is the longer of the radius of the first wheel 20 and the radius of the third wheel 22.

Consequently, as regards the second stage 97, the direction and the value of the offsets δ are identical but the direction of these offsets is reversed. Thus, the wheel spindle of a third wheel 101 of the third anchor cassette 98 is positioned offset by a value δ in a negative, third direction Y and the wheel spindle of a fourth wheel 103 of the fourth anchor cassette 99 is positioned offset by the value δ in a positive, third direction Y.

Thus, the component in the third direction Y of the contact force Fcy of the first wheel 20 of the first stage 96 and the component in the third direction Y of the contact force Fcy of the third wheel 101 of the second stage 97 compensate each other, thus limiting the risk of an axial rotation of the body 4, during its movement along the longitudinal axis of the casing. This residual risk of rotation is linked to the geometrical and dimensional defects of the different components of the torque anchor and casing assembly.

Advantageously, the torque anchor 95 according to this variant does not rotate about the centre C of the body 4 during its translational motion along the longitudinal axis of the casing 15. This configuration also improves the centring of the torque anchor 95 inside the casing 15. The resisting torque of the torque anchor 95 in both directions of rotation therefore becomes identical.

Figure 6:
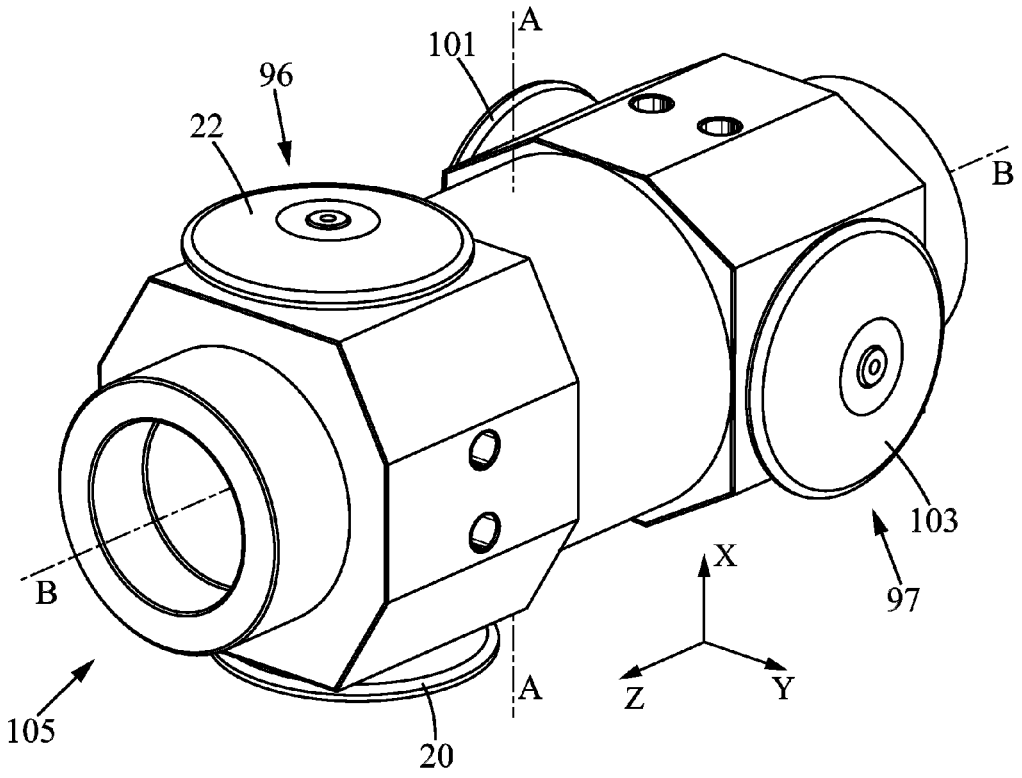
FIG. 6 is a perspective view of a second variant of the torque anchor illustrated in FIG. 1.
Figure 7:
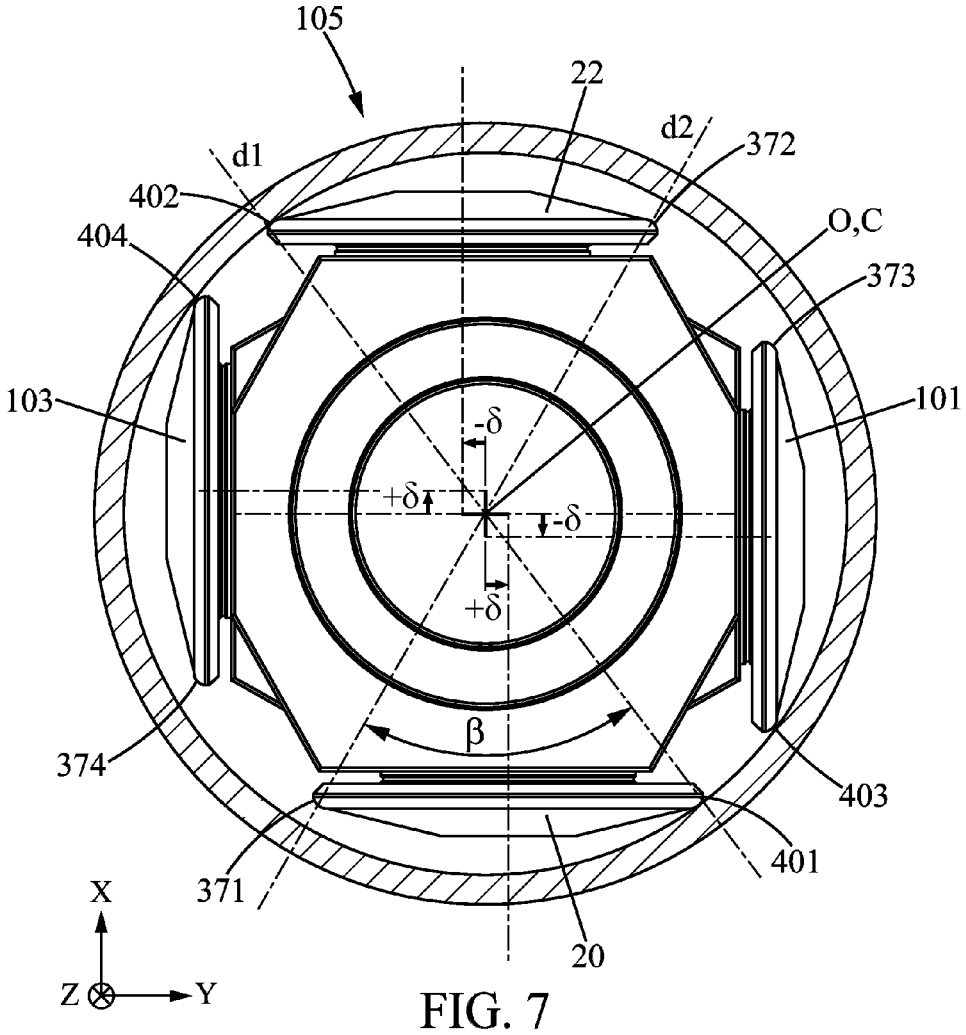
FIG. 7 is a top view of the torque anchor illustrated in FIG. 6.

According to a second embodiment variant illustrated in FIGS. 6 and 7, the torque anchor 105 comprises a first stage 96 and a second stage 97 similar to the first stage and the second stage of the torque anchor 95 illustrated in FIGS. 4 and 5. However, in this embodiment, the second stage 97 is, moreover, turned clockwise through an angle of 90° with respect to an axis parallel to the longitudinal axis of the casing before being fixed to the first stage 96.

Thus, according to this second variant, the geometric transformation linking the positioning of the anchor cassettes 98, 99 of the second stage 97 to the positioning of the anchor cassettes 12, 14 of the first stage 96 is an axial symmetry with respect to a first axis A-A, parallel to the second direction X and passing through the centre O of the casing followed by a rotation through an angle of 90° with respect to a second axis B-B parallel to the first direction Z and passing through the centre C of the body 4.

The first axis A-A is contained in a radial plane (X, Y) situated at a predefined distance from the plane containing the first wheel spindle and the second wheel spindle. Said predefined distance is greater than or equal to whichever is the longer of the radius of the first wheel 20 and the radius of the third wheel 22.

The centre C of the body 4 is a point situated on a straight line arranged equidistant from the outer faces of the body 4 and extending parallel to the first direction Z. The centre C of the body is merged with the centre of the casing 15, when the torque anchor is positioned centred inside the casing 15.

In particular, with reference to FIG. 7, the wheel spindles of the anchor cassettes 12, 14, of the first stage 96 extend in the second direction X and the wheel spindles of the anchor cassettes 98, 99 of the second stage 97 extend in the third direction Y.

In the first stage 96, the wheel spindle of the first wheel 20 and the wheel spindle of the second wheel 22 are positioned offset by a value δ in the third direction Y, the first in a positive direction and the second in a negative direction.

In the second stage 97, the wheel spindle of the first wheel 101 and the wheel spindle of the second wheel 103 are positioned offset by a value δ in the second direction X, the first in a negative direction and the second in a positive direction.

Just as for the first two-stage variant, this second two-stage variant 105 makes it possible to compensate certain components of the torques applied by the casing 15 to the wheels and thus limits a rotation of the body 4 during its translational motion along the casing 15 whilst increasing the centring of the torque anchor and its resisting torque.

As a variant, several two-stage torque anchors 95, 105 according to the first and/or the second variant are fixed to each other in order to increase the resisting torque whilst keeping the advantages linked with a better equilibrium of the torque anchor in the casing 15 by advantageously varying their angular offset in order to maximize the centring effect and minimize the damage to the casing.

Figure 8:
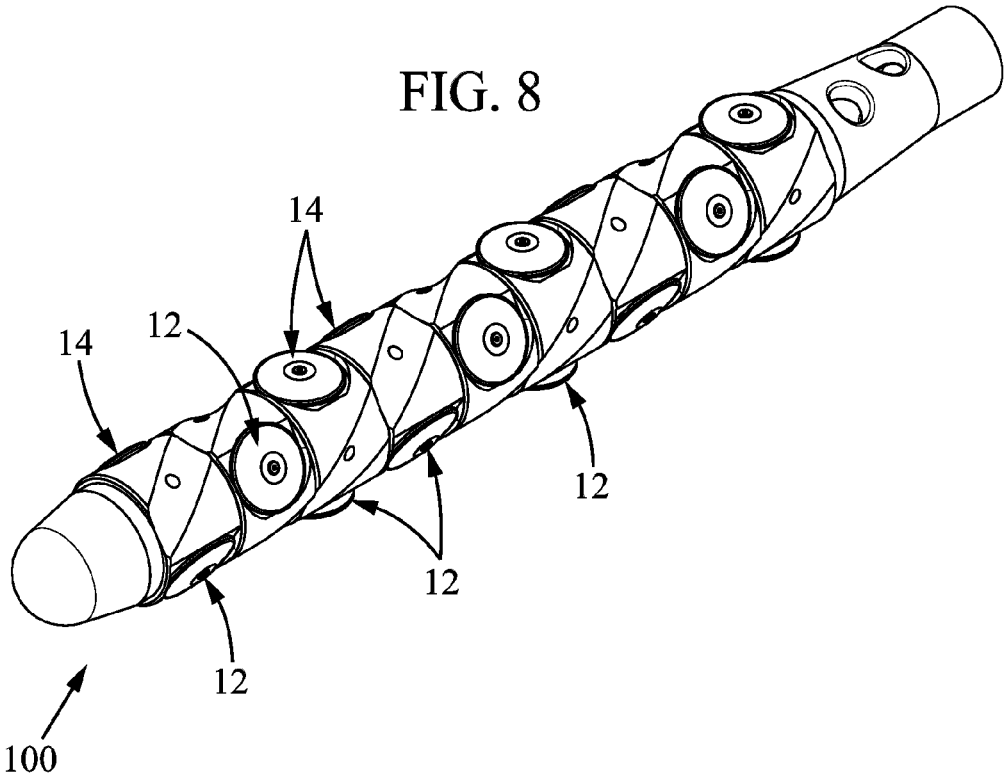
FIG. 8 is a perspective view of a third variant of the torque anchor illustrated in FIG. 1.

According to a third embodiment variant illustrated in FIG. 8, the torque anchor 100 comprises nine stages. Each stage comprises two anchor cassettes 12, 14. The anchor cassettes contained in two adjacent stages are offset by an angle of 60° with respect to each other.

According to a variant (not shown), the torque anchor according to the present invention comprises N stages each containing several anchor cassettes. The number of stages, N is preferably an even number.

The anchor cassettes are orientated with respect to each other along the circumference of the casing 15 and longitudinally along the casing 15 so that the sum of the angles defined between the wheel spindles is equal to 360°. Preferably, the anchor cassettes contained in two adjacent stages are offset by an angle of 90° with respect to each other.

Preferably, the positioning of the anchor cassettes of each even stage results from at least one axial symmetry with respect to an axis A-A parallel to the second direction X and passing through the centre O of the casing, with the positioning of the anchor cassettes situated in each odd stage.

Figure 9:
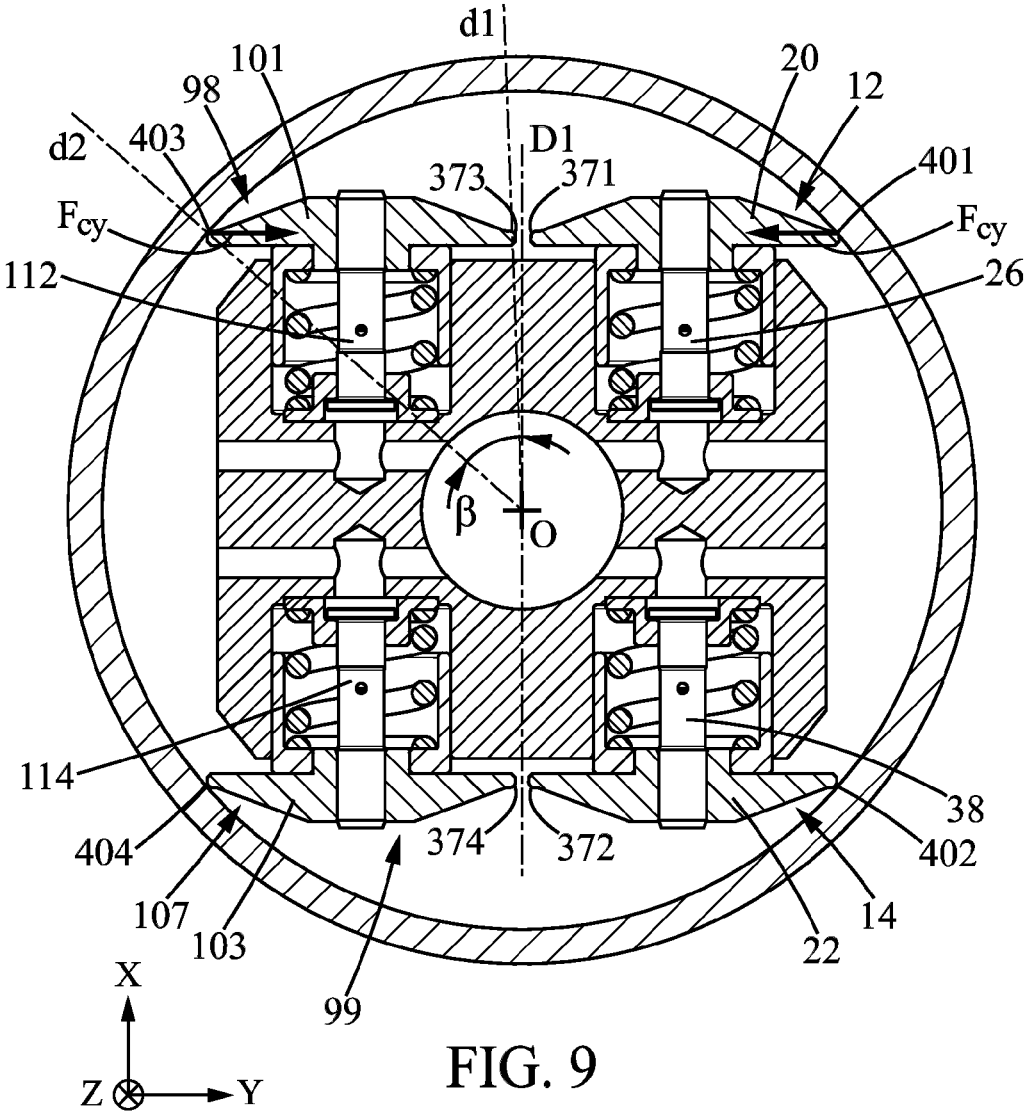
FIG. 9 is a cross-sectional view in a plane perpendicular to the axis of the casing of a torque anchor according to a second embodiment of the invention.

According to a second embodiment, illustrated in FIG. 9, the torque anchor 107 comprises a first anchor cassette 12, a second cassette 14, a third cassette 98 and a fourth anchor cassette 99 on the same stage, i.e. in one and the same radial plane (X, Y). These anchor cassettes 12, 14, 98, 99 are similar to the anchor cassettes described in the first embodiment and will not be described in detail a second time.

The wheel spindles 26, 38, 112, 114 of the four anchor cassettes 12, 14, 98, 99 extend in the second direction X. The first 12 and the third 98 anchor cassettes are arranged on one side of the second axial plane (Y, Z); in particular, on the positive side of the second direction X. The second 14 and the fourth 99 anchor cassettes are arranged symmetrically on the other side of the second axial plane (Y, Z); in particular, on the negative side of the second direction X.

Then, the first 12 and the second 14 anchor cassettes are arranged on one side of the first axial plane (Z, X); in particular, on the positive side of the third direction Y. The third 98 and the fourth 99 anchor cassettes are arranged symmetrically on the other side of the first axial plane (Z, X); in particular, on the negative side of the second direction X.

According to this embodiment, the first 26 and the second 38 wheel spindles are aligned behind one another. The component in the third direction Y of the contact force Fcy of the first wheel 20 is compensated by the component in the third direction Y of the contact force Fcy of the third wheel 101.

In the same way, the third 112 and the fourth 114 wheel spindles are aligned behind one another. The torque anchor 107 comes into contact with the casing at four points 401, 402, 403, 404. This configuration ensures good centring of the torque anchor 107 in the casing, limits the risks of rotation of the torque anchor on itself and can be used equally well with an even number or an odd number of stages.

Figure 10:
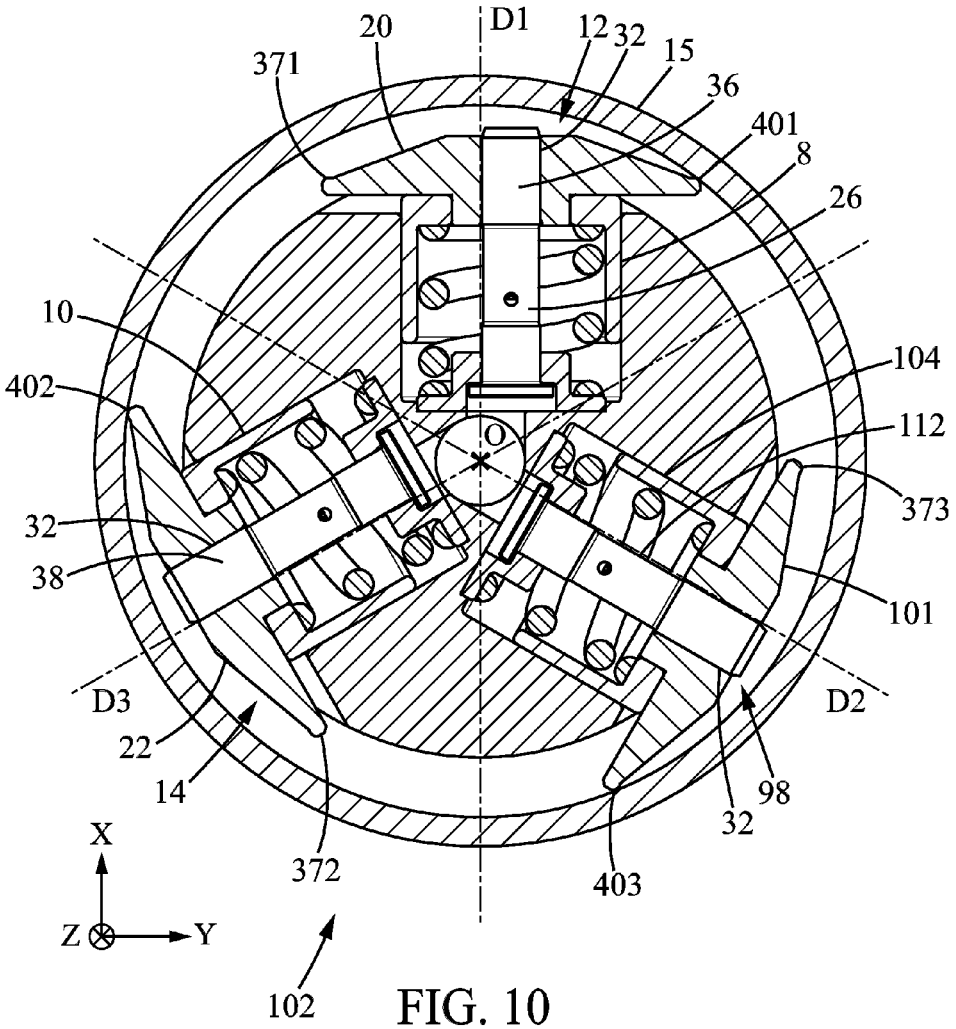
FIG. 10 is a cross-sectional view in a plane passing perpendicular to the axis of the casing of a torque anchor according to a third embodiment of the invention.

According to a third embodiment of the torque anchor 102, illustrated in FIG. 10, the body 4 comprises three housings 8, 10, 104 each containing an anchor cassette 12, 14, 98 similar to the anchor cassettes 12, 14 described in the first embodiment. Just as for the first embodiment, the wheel spindles 26, 38, 112 have each been offset in a direction perpendicular to a straight line D1, D2, D3 passing through the centre O of the casing and parallel to the central bore of each wheel spindle so that only a part of each wheel 20, 22, 101 engages with the casing 15 at one contact point 401, 402, 403 only, the remaining circumference 30 of each wheel 20, 22, 101 being at a distance from the casing. These offsets have been carried out in directions going in the same direction of rotation. Thus, the wheel spindles 26, 38, 112 are arranged substantially at 120° to each other and the points of contact 401, 402, 403 of the wheels are distributed substantially at equal angles with respect to the centre O of the casing 15.

Advantageously, this embodiment also makes it possible to better centre the body 4 in the casing. Thus, if a multi-stage torque anchor is produced starting from the torque anchor 102 comprising three anchor cassettes in one and the same stage i.e. in one and the same radial plane (X, Y), it is not necessary to produce an angular offset between the anchor cassettes of two adjacent stages.

According to a variant, it can be envisaged to produce the offset of the wheel spindles by turning the wheel spindles with respect to a centre arranged anywhere in the radial plane, combined or not combined with an offset, in order to ensure that only a part of the circumference 30 of each wheel engages with the casing 15, the remainder of the circumference 30 of each wheel being at a distance from the casing 15.

The present invention also relates to a pumping installation comprising a torque anchor 2, 95, 100, 102 105, 107 according to the present invention. In such a pumping installation, the torque anchor is advantageously arranged at the bottom of the pumping column, outside the fluid opening sections inside said production string.

Figure 11:
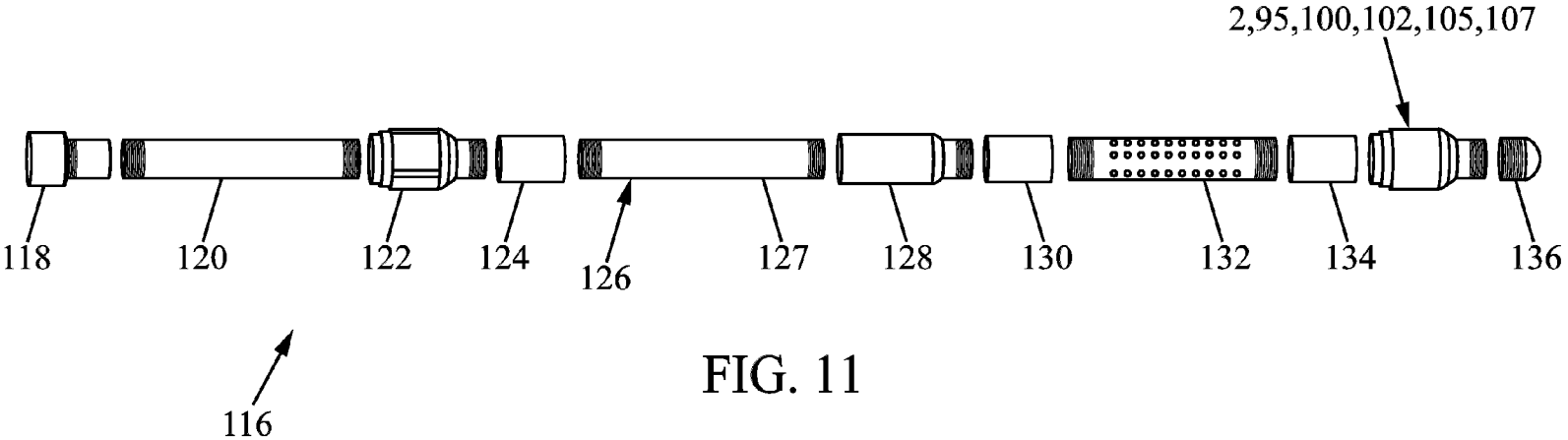
FIG. 11 is a side view of the belowground equipment of an oil, water or gas pumping installation according to the present invention.

In particular, with reference to FIG. 11, an oil, water or gas pumping installation 116 according to the present invention comprises, starting from the well surface and descending downhole:

- a bridge 118 generally called a "cross-over", the bridge makes it possible to distribute the pumped fluid in the tubing string,
- tubing components 120 fixed to the bridge 118 which may reach several kilometers in length,
- one or more anti-vibration devices 122 fixed to the tubing elements 120, these anti-vibration devices 122 make it possible to attenuate the vibrations originating from the rotation of the rotor inside the stator of the progressing cavity pump,
- a threaded connection 124 fixed to the anti-vibration device 122,
- a progressing cavity pump 126, positioned above or below the perforations, having a stator 127 fixed to the threaded connection 124, the progressing cavity pump 126 makes it possible to transfer the fluid to be pumped from the bottom of the well to the surface,
- a positioning stop 128 allowing the positioning of the rotor of the progressing cavity pump 126, generally called "stop bushing" or "tag bar"; the positioning stop 128 being fixed to the stator 127 of the progressing cavity pump 126,
- a threaded connection 130 fixed to the positioning stop 128,
- filtering equipment 132 in the general form of a perforated tube, generally known as a perforated pipe, slotted screen or sand screen, fixed to the tube 130 allowing the filtration of the pumped fluid inside the production string, the filtering equipment 132 is fixed to the threaded connection 130,
- a threaded connection 134 fixed to the filtering equipment 132,
- a torque anchor 2, 95, 100, 102, 105, 107 according to the present invention fixed to the threaded connection 134, and finally
- a debris collector 136 generally called a "bull plug" fixed to the torque anchor according to the present invention.

Since it is a solid body, the torque anchor is placed at the lower end of the belowground equipment of the pumping installation. Advantageously, this positioning makes it possible to reduce the vibrations emanating from the pumping equipment and thus to separate the anti-rotation and anti-vibration functions of the torque anchor.

Figure 12:
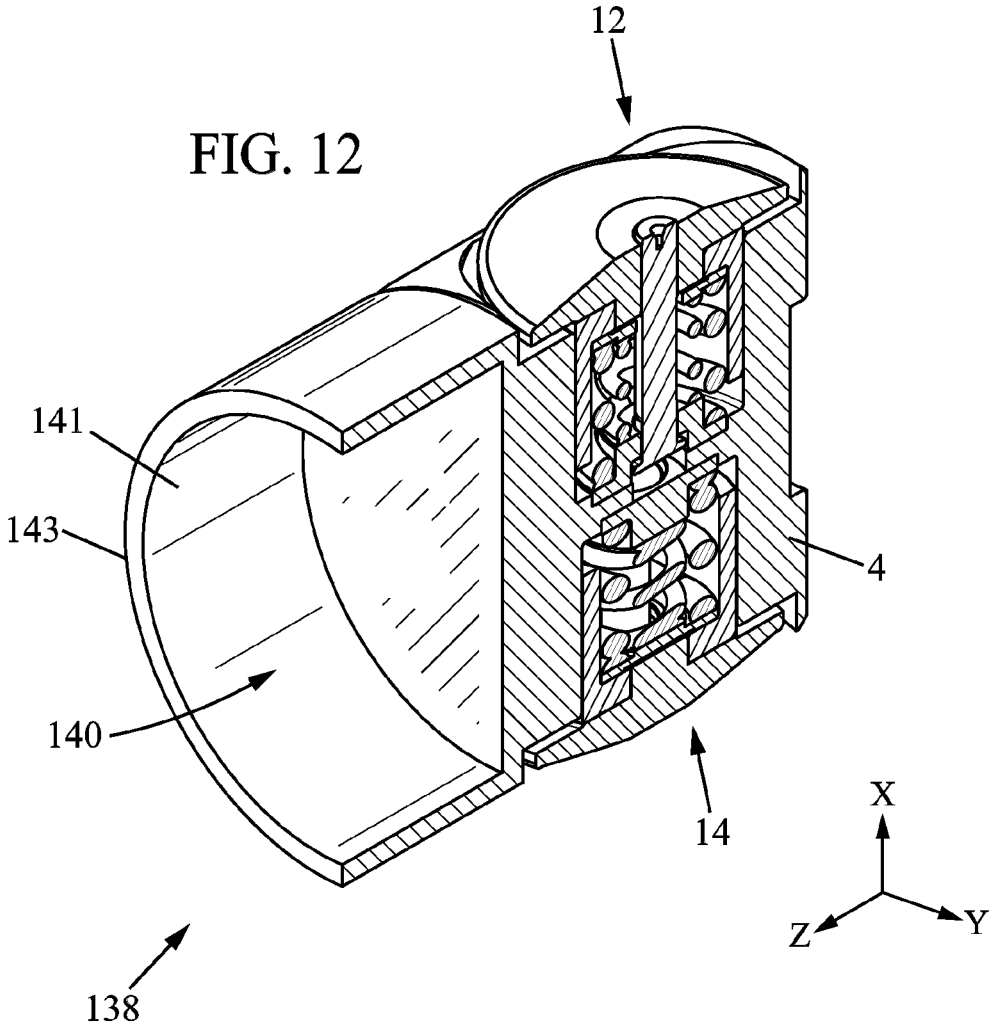
FIG. 12 is a cut-away perspective view of a torque anchor according to a variant of the first embodiment of the invention.

With reference to FIG. 12, according to a variant of the first embodiment, the torque anchor 138 comprises a reservoir 140 having an opening 141 extending within the prolongation of an end face of the body. This reservoir 140 opens in a radial plane (X, Y). It has a depth extending in the first direction Z. The edge 143 of this reservoir is intended to be fixed to the stator 127 of a progressing cavity pump 126.

This reservoir 140 at the same time performs the function of the positioning stop 128 and of debris collector 136. Although illustrated in FIG. 12 with a body comprising two anchor cassettes 12, 14, this reservoir 140 can also be provided in a body having several stages of two or more anchor cassettes.

Figure 13:
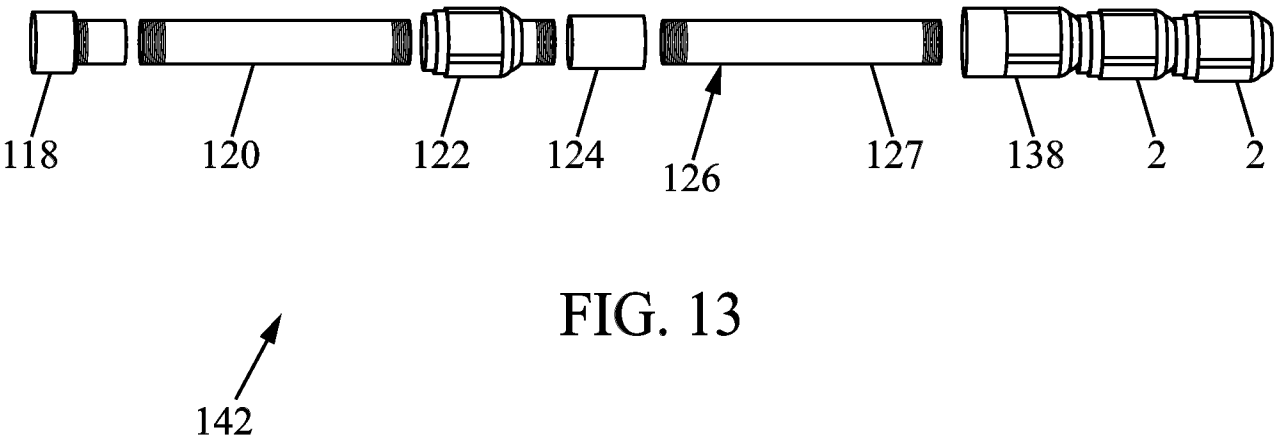
FIG. 13 is a side view of the belowground equipment of an oil, water or gas pumping installation according to the present invention.

With reference to FIG. 13, the present invention also relates to an oil, water or gas pumping installation 142 comprising an assembly of torque anchors 138, 2, 2 according to the present invention fixed directly to the stator 127 of a progressing cavity pump in the production chain.

Advantageously, this torque anchor assembly comprises a torque anchor 138 comprising a reservoir as illustrated in FIG. 9 and two torque anchors 2 according to the first embodiment of the invention as illustrated in FIGS. 1 and 2.

Thus, the installation 142 comprising a torque anchor 138 according to the second embodiment no longer comprises positioning stop 138 and debris collector 136.

It is possible to vary the resisting torque of a torque anchor assembly either by multiplying the stages of the torque anchor or by fixing several single-stage torque anchors together. Thus, it is possible to adapt the resisting torque of a torque anchor or of a torque anchor assembly as a function of the torque generated by the downhole hydraulics during a pumping operation. In this case, the anchor cassettes of each stage are advantageously angularly offset about the centre of the casing 15 to promote the centring of the torque anchor inside this casing and minimize damage to the casing by cyclic hardening.

According to the embodiments described, the housings extend in the same direction as the wheel spindles. As a variant, it is possible to produce a torque anchor in which the housings containing the anchor cassettes have a different shape, for example when they also house other elements.

As a variant, the body 4 comprises two fluid openings 94 linking the inner chamber 78 to the outside of the body 4.

As a variant, the wheel does not comprise a flange 52 and it is the cylindrical portion 46 of the wheels which is in contact with the casing 15, when the torque anchor is installed therein.

Advantageously, this torque anchor is easy to manufacture, maintain, and test at the surface without risk to the operator.

As a variant, the circumference 30 of the wheel in contact with the casing is not arranged on the outer circular face 42, but on the cylindrical portion 46.

As a variant, the collar 90 is replaced by a circlip or a locking ring so that it is possible to dismantle the anchor cassette for maintenance, recycling of the main parts and generally in order to limit the scrapping of components.

As a variant, the first wheel 20 is fixed to the first wheel spindle 26 by threading and by mounting a locking ring on the first wheel spindle. This variant also makes it possible to dismantle the anchor cassette for maintenance.

The invention claimed is:

1. A torque anchor intended to block the rotation of a production string with respect to a casing of a well having a longitudinal axis; the torque anchor comprising:

- a body;
- anchor cassettes borne by said body, each anchor cassette comprising a wheel having a circumference and a wheel spindle supporting said wheel, said wheel spindle having a first end; and
- a contact point of said circumference of said wheel being intended to come into contact with said casing, an opposite point being arranged diametrically opposite said contact point,
- wherein, for each anchor cassette, said wheel is mounted on said first end of said wheel spindle and wherein a positioning angle comprised between 30° and 180° is defined between a first straight line and a second straight line, said first straight line passing through a centre of said casing and the contact point, said second straight line passing through said centre of said casing and said opposite point, and wherein, in each anchor cassette, said wheel is mobile in a direction of movement parallel to said wheel spindle and in which each anchor cassette comprises a loading device suitable for exerting a force on said wheel in said direction of movement in order to anchor said wheel in said casing.

2. The torque anchor according to claim 1, in which said loading device comprises N springs distributed regularly about said wheel spindle, N being a natural integer greater than or equal to one.

3. The torque anchor according to claim 2, in which N is equal to two, said two springs being arranged co-axially with said wheel spindle, and in which said anchor cassette comprises a thrust washer arranged between said wheel and said springs.

4. The torque anchor according to claim 2, in which each of said anchor cassettes comprises a bearing suitable for supporting said wheel and in which each bearing comprises a protrusion delimiting an inner chamber containing said N springs, said protrusion being suitable for guiding said N springs in translational motion in said protrusion as well as in rotation about said wheel spindle.

5. The torque anchor according to claim 4, wherein said body has an outside and which comprises at least one fluid opening between said outside of said body and said inner chamber.

6. The torque anchor according to claim 4, in which said body comprises an outside and a plurality of housings forming a plurality of slide opening towards said outside; each housing being suitable for containing one of said anchor cassettes, and in which each bearing is suitable for sliding in one of said plurality of housings, each bearing adhering to one of said plurality of housings by addition of grease to their interface.

7. The torque anchor according to claim 4, in which said bearing is made of ceramic material.

8. The torque anchor according to claim 1, in which said body comprises an outside and a plurality of housings forming a plurality of slide openings towards said outside; each housing being suitable for containing one of said anchor cassettes.

9. The torque anchor according to claim 1, in which each anchor cassette each comprises a thrust bearing suitable for bearing said wheel spindle, said thrust bearing comprising at least one shoulder forming a bearing surface for said loading device.

10. The torque anchor according to claim 9, in which a second end of said wheel spindle is provided with a collar and in which said thrust bearing comprises an inner circular recess suitable for receiving said collar in order to pre-stress said loading device.

11. The torque anchor according to claim 9, in which said thrust bearing is made of ceramic material.

12. The torque anchor according to claim 1, in which said wheel spindles are flush-fitted to said wheels.

13. The torque anchor according to claim 1, wherein said wheel spindles are contained in a plane and which further comprises a reservoir having an opening which extends in a plane substantially parallel to said plane containing said wheel spindles.

14. The torque anchor according to claim 1, wherein said wheels have a diameter and said casing has an internal diameter, and in which said diameter of said wheels is comprised between 20% and 80% of the value of said internal diameter of said casing.

15. The torque anchor according to claim 1, in which said wheels have an outer circular face having a peripheral edge which is provided with a flange intended to come into contact with said casing, when said torque anchor is installed in said casing.

16. The torque anchor according to claim 1, in which said wheels are suitable for applying to said casing a theoretical contact pressure calculated according to Hertz's formulae comprised between 2 and 20 times the elastic limit of said casing.

17. The torque anchor according to claim 1, in which said body comprises a first direction, a second direction and a third direction defining an orthonormal matrix; said first direction extending parallel to said longitudinal axis of said well, when said torque anchor is arranged in said casing; said body also comprises a radial plane containing said second direction and said third direction, a first axial plane containing said first direction and said second direction and a second axial plane containing said first direction and said third direction, said first axial plane and said second axial plane passing through said centre of said casing;

and in which said anchor cassettes comprise a first anchor cassette and a second anchor cassette arranged in a first radial plane, known as the first stage; said first anchor cassette comprises a first wheel spindle and said second anchor cassette comprises a second wheel spindle; said first wheel spindle and said second wheel spindle are parallel to each other and are arranged on either side of said second axial plane; said first wheel spindle and said second wheel spindle being offset with respect to said centre of said casing by the same offset value in said third direction.

18. The torque anchor according to claim 17, which further comprises a third anchor cassette and a fourth anchor cassette arranged in a second radial plane, known as the second stage; said second stage being offset in said first direction with respect to said first stage; and in which said third anchor cassette and said fourth anchor cassette are positioned with respect to said first anchor cassette and said second anchor cassette according to a geometric transformation comprising at least one axial symmetry with respect to a first axis parallel to said second direction and passing through said centre of said casing; said axis being contained in a radial plane situated at a predefined distance from said plane containing said first wheel spindle and said second wheel spindle.

19. The torque anchor according to claim 17, which comprises a third anchor cassette and a fourth anchor cassette arranged in a second radial plane, known as the second stage; said second stage being offset in said first direction with respect to said first stage; and in which said third anchor cassette and said fourth anchor cassette are positioned with respect to said first anchor cassette and said second anchor cassette according to a geometric transformation comprising a rotation, for example, through an angle of 90°, with respect to an axis parallel to said first direction and passing through said centre of said body.

20. The torque anchor according to claim 1, in which said body comprises a first direction, a second direction and a third direction defining an orthonormal matrix; said first direction extending parallel to said longitudinal axis of said well, when the torque anchor is arranged in said casing; said body also comprises a radial plane containing said second direction and said third direction, a first axial plane containing said first direction and said second direction and a second axial plane containing said first direction and said third direction, said first axial plane and said second axial plane passing through said centre of said casing;

and in which said anchor cassettes comprise a first anchor cassette, a second anchor cassette, a third anchor cassette and a fourth anchor cassette arranged in one and the same radial plane, said wheel spindles of each anchor cassette are parallel to each other; said first anchor cassette and said third anchor cassette are arranged on one side of said second axial plane; said second anchor cassette and said fourth anchor cassette are arranged on the other side of said second axial plane; said first anchor cassette and said second anchor cassette are arranged on one side of said first axial plane, said third anchor cassette and said fourth anchor cassette are arranged on the other side of said first axial plane.

21. A pumping installation comprising a torque anchor according to claim 1.

22. The torque anchor according to claim 1, in which said positioning angle is between 60° and 90°.

23. The torque anchor according to claim 1, in which said wheel spindles are shrink-fitted to said wheels.

24. The torque anchor according to claim 1, in which said wheels are suitable for applying to said casing a theoretical contact pressure calculated according to Hertz's formula between 4 and 10 times said elastic limit of said casing.

25. A torque anchor according to claim 1 wherein each wheel has only one contact point with the casing, the contact points of the wheels are distributed equiangularly with each other in the casing when the torque anchor is arranged in the casing.

26. A torque anchor intended to block the rotation of a production string with respect to a casing of a well having a longitudinal axis; the torque anchor comprising:

a body;

anchor cassettes borne by said body, each anchor cassette comprising a wheel having a circumference and a wheel spindle supporting said wheel, said wheel spindle having a first end; and a contact point of said circumference of said wheel being intended to come into contact with said casing, an opposite point being arranged diametrically opposite said contact point, wherein, for each anchor cassette, said wheel is mounted on said first end of said wheel spindle and wherein a positioning angle comprised between 30° and 180° is defined between a first straight line and a second straight line, said first straight line passing through a centre of said casing and the contact point, said second straight line passing through said centre of said casing and said opposite point, wherein in which, in each anchor cassette, said wheel is mobile in a direction of movement parallel to said wheel spindle and in which each anchor cassette comprises a loading device suitable for exerting a force on said wheel in said direction of movement in order to anchor said wheel in said casing, and wherein said loading device comprises N springs distributed regularly about said wheel spindle, N being a natural integer greater than or equal to one, Wherein N is equal to two, said two springs being arranged co-axially with said wheel spindle, and in which said anchor cassette comprises a thrust washer arranged between said wheel and said springs.

27. A torque anchor intended to block the rotation of a production string with respect to a casing of a well having a longitudinal axis; the torque anchor comprising:

a body;

anchor cassettes borne by said body, each anchor cassette comprising a wheel having a circumference and a wheel spindle supporting said wheel, said wheel spindle having a first end; and a contact point of said circumference of said wheel being intended to come into contact with said casing, an opposite point being arranged diametrically opposite said contact point, wherein, for each anchor cassette, said wheel is mounted on said first end of said wheel spindle and wherein a positioning angle comprised between 30° and 180°, is defined between a first straight line and a second straight line, said first straight line passing through a centre of said casing and the contact point, said second straight line passing through said centre of said casing and said opposite point, and wherein, in each anchor cassette, said wheel is mobile in a direction of movement parallel to said wheel spindle and in which each anchor cassette comprises a loading device suitable for exerting a force on said wheel in said direction of movement in order to anchor said wheel in said casing, in which each anchor cassette comprises a thrust bearing suitable for bearing said wheel spindle, said thrust bearing comprising at least one shoulder forming a bearing surface for said loading device, a second end of said wheel spindle being provided with a collar, said thrust bearing comprising an inner circular recess suitable for receiving said collar in order to pre-stress said loading device.

* * * * *